US012698142B2

(12) United States Patent
Kasimatis et al.

(10) Patent No.: US 12,698,142 B2
(45) Date of Patent: Aug. 4, 2026

(54) SINGLE-MATERIAL TUBE ADAPTER FOR RELEASABLE CONNECTION TO SPOUT FITMENT AND METHOD OF SEALING AND USING SAME

(71) Applicant: RAPAK, LLC, Bloomfield Hills, MI (US)

(72) Inventors: Kosmas Kasimatis, Woodridge, IL (US); Rafael Caponegri, Woodridge, IL (US)

(73) Assignee: RAPAK, LLC, Bloomfield Hills, MI (US)

( * ) Notice: Subject to any disclaimer, the term of this patent is extended or adjusted under 35 U.S.C. 154(b) by 122 days.

(21) Appl. No.: 18/436,173

(22) Filed: Feb. 8, 2024

(65) Prior Publication Data

US 2025/0256900 A1 Aug. 14, 2025

(51) Int. Cl.
*B65D 75/58* (2006.01)
*B65D 77/06* (2006.01)

(52) U.S. Cl.
CPC ..... *B65D 75/5872* (2013.01); *B65D 75/5877* (2013.01); *B65D 77/065* (2013.01); *B65D 2547/06* (2013.01)

(58) Field of Classification Search
CPC ..... B65D 75/5872; B65D 2547/06; B65D 77/065; B65D 75/5877
See application file for complete search history.

(56) References Cited

U.S. PATENT DOCUMENTS

| | | | | |
|---|---|---|---|---|
| 3,081,911 | A | 3/1963 | Scholle | |
| 4,257,535 | A | 3/1981 | Mellett | |
| 4,286,636 | A | 9/1981 | Credle | |
| 4,375,864 | A | 3/1983 | Savage | |
| 4,570,826 | A | 2/1986 | Fattori | |
| 4,601,410 | A | 7/1986 | Curtis | |
| 5,647,511 | A | 7/1997 | Bond | |
| 5,749,493 | A | 5/1998 | Boone et al. | |
| 6,053,360 | A | 4/2000 | Rutter | |
| 6,607,097 | B2 | 8/2003 | Savage et al. | |
| 7,757,907 | B2 | 7/2010 | Smith | |
| 7,770,360 | B2 | 8/2010 | Smith | |
| 8,459,511 | B2 | 6/2013 | Darby | |
| 8,752,734 | B2 | 6/2014 | Smith | |
| 9,592,944 | B2 * | 3/2017 | Johnson | B65D 75/5872 |
| 10,051,990 | B2 | 8/2018 | Peterson | |
| 10,875,694 | B2 | 12/2020 | Georgelos | |
| 10,981,190 | B2 * | 4/2021 | Johnson | B05B 15/65 |
| 11,027,960 | B2 | 6/2021 | Kraenzle | |
| 11,117,710 | B2 | 9/2021 | Georgelos | |
| 11,572,224 | B2 * | 2/2023 | Ruschmeier | B65D 51/002 |
| 2015/0336719 | A1 | 11/2015 | Bradley | |

* cited by examiner

*Primary Examiner* — Frederick C Nicolas
(74) *Attorney, Agent, or Firm* — McDonald Hopkins LLC

(57) ABSTRACT

An adapter is configured with two base platforms, initially tethered together, that separately receive a dispensing tube and attached to a standardized spout fitment at opposite ends. In use, the platforms collapse and lock together, while simultaneously creating an outwardly bellowing section in the tube that can double as a sealing gasket. The adapter is sized to couple to existing spout fitments and tube sizes to allow for easy adoption, while its components may all be constructed from the same polymeric material to facilitate manufacturing and/or recycling.

13 Claims, 6 Drawing Sheets

SINGLE-MATERIAL TUBE ADAPTER FOR RELEASABLE CONNECTION TO SPOUT FITMENT AND METHOD OF SEALING AND USING SAME

RELATED APPLICATIONS AND TECHNICAL FIELD

This application relates generally to fitments and adapters used in the liquid dispensing industry apparatus and, more specifically, to a collapsible tube connection assembly made from a single polymeric material that is attachable to the spout fitment on a pouch or container, along with a method for connecting such components.

BACKGROUND

Flexible, pouch-style containers are well known in the art for storing and dispensing liquids, foodstuffs, other flowable materials. These containers are formed from one or more polymeric and/or metallized film layers selected for the specific storage conditions dictated by the liquid in question. The pouch can be completely sealed on all sides, or it can be open at its top end. In either case, the pouch is filled and then seated within a rigid containment structure (e.g., a paperboard box, a plastic pail, etc.), with the expectation that a dispensing tube attached to the pouch will be used to drain the liquid from the container.

While a variety of technical distinctions can be made, these arrangements can generally be referred to as "bag-in-box" or BIB. Bag-in-box systems have enjoyed wide success in a number of industries, most notably for use in containing and dispensing soft drink syrup and other liquid products. Prior art examples of such systems are shown in U.S. Pat. Nos. 4,286,636; 4,601,410; 5,647,511; 5,749,493; and 6,607,097.

The outlet of the pouch is usually positioned near the lower most portion of the pouch and containment structure, so that the force of gravity facilitates dispensing. In this context, the outlet typically includes an annular spout fitment having a radially flange that can be sealed to a surface the pouch/container immediately adjacent to the outlet. A dispensing tube can be attached to an adapter, with the adapter being attachable to the spout, so that a pump, faucet, tap, or valve structure accommodating or connecting to the tube, so as meet the desired or required dispensing needs of the user/fluid in question. Significantly, the dispensing tube is deliberately or incidentally used to move and position the bag, so it is often important for the tube to be locked securely in place when it is attached to the pouch/fitment.

In many cases, BIB bags are provided with a spout, and possibly even the tube adapter, during the bag manufacturing process. As noted above, the spout typically has a flange that is heat sealed to the bag, with the adapter being attached to the spout separately so as to enable the use of a single, standardized spout in combination with adapters that are sized and constructed for the intended use (e.g., aseptic, high or low flow, specific materials, etc.). These completed bags are transported to manufacturers or end users who fill the bags, which may be used immediately or resealed (at an inlet spout) and placed in the rigid container for transport to commercial establishments where a pump or tap can be attached.

U.S. Pat. Nos. 7,770,360 and 7,757,907 provide examples of spout fitments, while examples of adapters can be found in U.S. Pat. Nos. 11,117,710; 6,053,360; and 4,570,826. Further information on the attachment, use, and configuration of the various elements found in BIB arrangements can also be found in U.S. Pat. Nos. 10,875,694; 10,051,990; 8,752,734; and 4,257,535; while some early proposals and additional context can be gleaned from U.S. Pat. Nos. 4,375,864 and 3,081,911.

For the sake of clarity and to further highlight and contrast with certain aspects of the invention disclosed herein, all of the aforementioned disclosures are incorporated by reference into this Background section. Specifically, these patents provide context and further background information on the function and utility of the spout fitments and adapters described above.

Given the longstanding use of such spout fitments and tube adapters, any innovation that reduces costs and/or enhances the utility (e.g., wider range of options, eliminates multiple and/or incompatible materials used to make the components, etc.) would be welcome. Also, a tube adapter that can be selectively detached and replaced, as well as an adapter that can be made as unitary piece from the same polymeric material as the spout fitment and/or the bag itself is desirable. Finally, a configuration that can be locked in place and provides the user with tactile feedback and/or visual assurance that the tube adapter is definitively coupled to the fitment, while also providing an integral, gasket-like seal without the need for positioning/using any additional parts, are also needed.

SUMMARY OF INVENTION

A unitary tube clip assembly is contemplated. The assembly receives and couples to an elastomeric tube, with a bellowing section of the tube helping to secure the seal and lock the tube to the assembly. The assembly itself is made from a unitary annular component that has distinct tube-base tethered to a spout-base components so that these two platforms can be pushed together to secure the tube. Locking mechanisms, preferably in the form of slot-and-bayonet or a flange-and-post configuration, are provided near the periphery of each base. The unitary annular component can be injection molded from a single polymeric material, and that material may also match the material used to construct the pouch so as to facilitate disposal and recycling of the assembly.

Specific reference is made to the appended claims, drawings, and description, all of which disclose elements of the invention. While specific embodiments are identified, it will be understood that elements from one described aspect may be combined with those from a separately identified aspect. In the same manner, a person of ordinary skill will have the requisite understanding of common processes, components, and methods, and this description is intended to encompass and disclose such common aspects even if they are not expressly identified herein.

DESCRIPTION OF THE DRAWINGS

Operation of the invention may be better understood by reference to the detailed description taken in connection with the following illustrations. These appended drawings form part of this specification, and any information on/in the drawings is both literally encompassed (i.e., the actual stated values) and relatively encompassed (e.g., ratios for respective dimensions of parts). In the same manner, the relative positioning and relationship of the components as shown in these drawings, as well as their function, shape, dimensions, and appearance, may all further inform certain aspects of the invention as if fully rewritten herein. Unless otherwise stated, all dimensions in the drawings are with reference to inches, and any printed information on/in the drawings form part of this written disclosure.

In the drawings and attachments, all of which are incorporated as part of this disclosure:

FIG. 4B shows a capture facing with guiding keys on the tube base and a resilient post with a locking wedge/flange on the spout base, and FIG. 4C shows a slot and bayonet configuration in which the slots are formed in the tube base of the platform.

DETAILED DESCRIPTION OF EMBODIMENTS

Figure 1A:
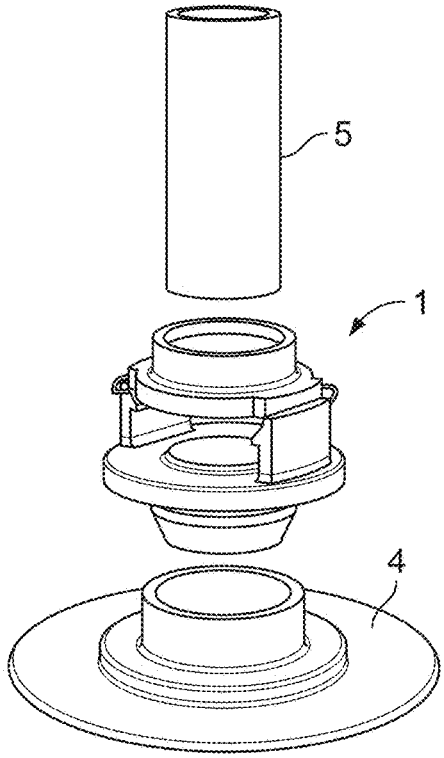
FIG. 1A is a three dimensional, exploded view of the collapsible tube adapter assembly and spout fitment according to various disclosed aspects, with FIG. 1B providing a comparable view of these components in their assembled and locked position and FIG. 1C providing a cross sectional view taken along a diameter of the assembly in FIG. 1B.
Figure 1B:
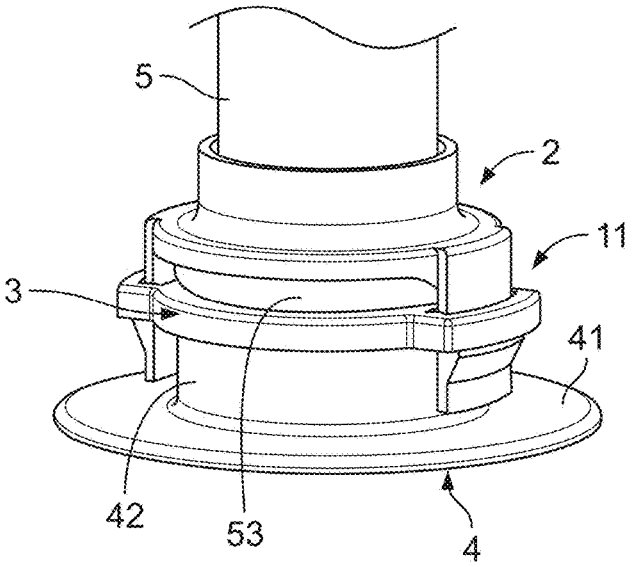
Figure 1C:
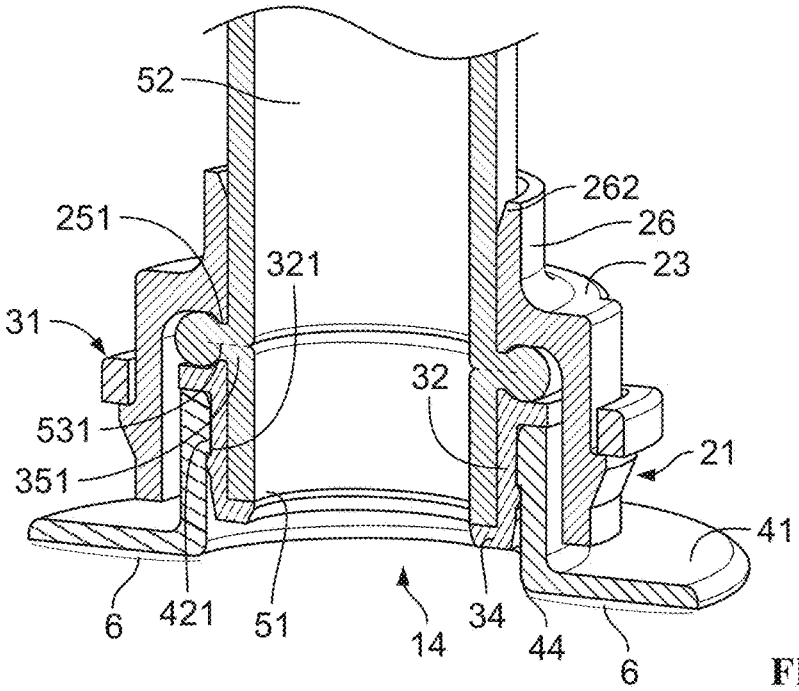

As used herein, the words "example" and "exemplary" mean an instance, or illustration. The words "example" or "exemplary" do not indicate a key or preferred aspect or embodiment. The word "or" is intended to be inclusive rather an exclusive, unless context suggests otherwise. As an example, the phrase "A employs B or C," includes any inclusive permutation (e.g., A employs B; A employs C; or A employs both B and C). As another matter, the articles "a" and "an" are generally intended to mean "one or more" unless context suggest otherwise.

Understanding that many of the components described below possess an annular shape, in which a central aperture is surrounded by cylindrical walls and other structures, the axis and axial direction of the components will align along a line/axis that runs through the middle central aperture (and coincides with the anticipated direction of fluid flow passing through the aperture). Notably this central axis also aligns with the top and bottom of the page in the drawings, and the terms axial, vertical, top/bottom, or up/down may be used synonymously. In the same manner, radial or transverse directions or features in the drawings will run orthogonally to the central axis, so that references to radial, transverse, horizontal, or left/right may be used interchangeably. It will also be understood that any cross sectional or regular three dimensional views in the drawings are intended to encompass the comparative order and arrangement of the components depicted, so that the positioning of a portion of one component above or coaxially inside/around a second component should be interpreted as being disclosed and embraced by this written description. In all such instances, the terms and directions should be read in the context of the broader disclosure and with respect to the known and anticipated uses of the components being described.

With reference to FIGS. 1A through 7, in which common and/or related reference numerals may be used throughout, a collapsible tube adapter 1 allows for low profile connections to be made between a tube 5 and the spout fitment 4 attached to an inlet and/or outlet on a pouch or flexible bag 6. Specifically, the adapter 1 has an annular shape defining an inner flow channel 14, with two a tube base platform 2 and a spout base platform 3. The tube base receives and positions the tube 5 from a top facing of the adapter, while the spout base 3 couples to the spout fitment 4 at the bottom. As described below, the process for attaching the various components 1, 4, and 5 causes the tube base 2 to collapse toward the spout base 3 while crimping a section of the tube 5 in a manner that effectively creates a de facto o-ring or gasket seal.

Locking features 11 formed integrally at a periphery of the adapter components cooperate with one another to retain and, in some cases, selectively release the tube 5 from the adapter 1/fitment 4 (generally speaking, the attachment of the spout base 3 to the fitment 4 is expected to be permanent). These features 11 may rely on slot and bayonet configuration 12 or post and flange configuration 13, but in both cases the features 11 align and cooperate to allow for snap-fitting connections and release, in which locking mechanism components 11 on one or both of the tube base 2 and the spout base 4 resiliently engage to retain connection of and between the bases 2, 3.

Generally speaking, the spout fitment 4, along with the tube adapter 1 and tube 5, are designed to accommodate an outlet and flow channel 14 having a circular cross sectional profile. However, it may be possible to employ other cross sectional shapes or features while still adhering to selected aspects of the invention so long as the components cooperate and seal together appropriately. Also, with respect to the spout fitment, the aspect depicted in FIGS. 3A and 3B may find particular utility with the various aspects of the tube adapter described herein, but it is possible to utilize other spout fitments (including those described in the background above.

The spout fitment 4 includes a radial flange 41 that presents with an annular surface that can be adhered, heated sealed, or otherwise attached to a corresponding facing on the insider or outside of the bag. As such, the spout fitment 4 has an annular shape with engagement tube 42 defining the fluid flow channel 14. Tube 42 includes a wall 421 that extends above and away from radial flange 41. In some aspects, a stepped section 43 can be interposed between the tube wall 421 and the outer periphery of the flange 41. In some aspects, the junction 44 between the wall 421 and the flange 41 and/or stepped section 43 is formed at a right angle, with arcuate engagement sections 422 (or possibly a full annular ridge) extending axially downward below and away from the wall 421 on the bottom side facing of the fitment 4. Arcuate sections 422 provide an engagement surface for a corresponding engagement feature 321, possibly in the form of a ramp and/or wedge, and the spaces between the sections 45 may allow for easier flexing and connection of the components 3, 4. In some aspects, engagement features can be provided on the inner facing of the wall 421 in addition to or in place of cooperating features 321, 45.

The adapter 1 is configured to engage the fitment 4 by way of a variety of locking mechanisms 11. The coupled adapter and fitment create a sealed flow path 14 between an inlet defined by the bottom facing of the spout 4 and the distal end of the tube 5 (which typically is coupled to or received by a valve, faucet, pump, or other similar means for dispensing). Notably, one of the advantages of the invention is its ability to create an outward bellowing section 53 in the tube 5 that is captured as the tube base 2 and the spout base 3 join together.

The adapter 1 is preferably formed as a single unitary object, despite it having discretely identified platforms in the form of tube base 2 and spout base 3. Specifically, a small tether 231, 331 connected the bases 2, 3 and allows for the molding of the adapter 1 as a single piece. The length of the tether connections 231, 331 will be related to the length of axial travel required between the bases 2, 3. In turn, the axial travel between the bases 2, 3 may be dictated, at least in part by the need to allow or prevent access to the locking mechanism 11—and particularly, the spacing between the radial flange 41 and the lower extremities of mechanism 11 (e.g., the lower tip of flange/wedge 124, 134, the side surface of the post 13, etc.).

As noted above, a two part locking mechanism 11 has discrete and cooperating features formed at or near the peripheral/radial edges of each base 2, 3. Generally speaking, the mechanism 11 may be a slot and bayonet 12 capture system, in which a slot or aperture 123 is provided in one surface and a corresponding axially aligned post with a tapered or wedge-like edge 124 being sized to fit and remain captured therein.

Alternatively, the post/flange capture mechanism 13 also relies on a wedge 134 formed on a post that couples to a ledge or flanged capture surface 133. In both instances, the components are configured and sized to allow for the parts to flex and/or snap-fit into place, with the aperture 123 or capture surface 133 provided on either the tube base 2 or the spout base and the corresponding wedge 124, 133 provided on the other base.

Figure 4A:
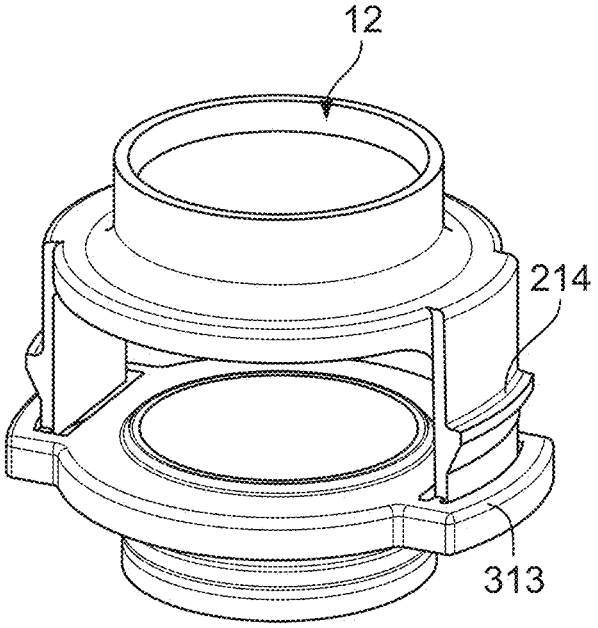
FIGS. 4A through 4C are three dimensional views of the tube adapter (but with FIG. 4C also depicting the tube attached thereto) with various alternative configurations for the locking features. In particular, FIG. 4A contemplates a slot and bayonet configuration in which the slots are formed in the spout base of the platform.
Figure 4B:
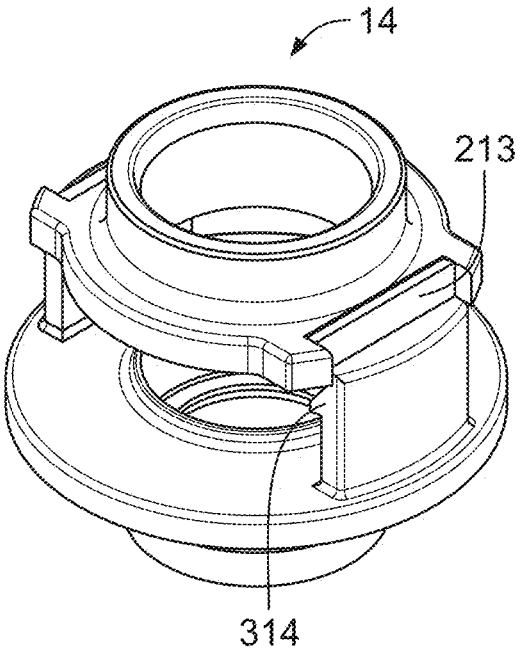
Figure 4C:
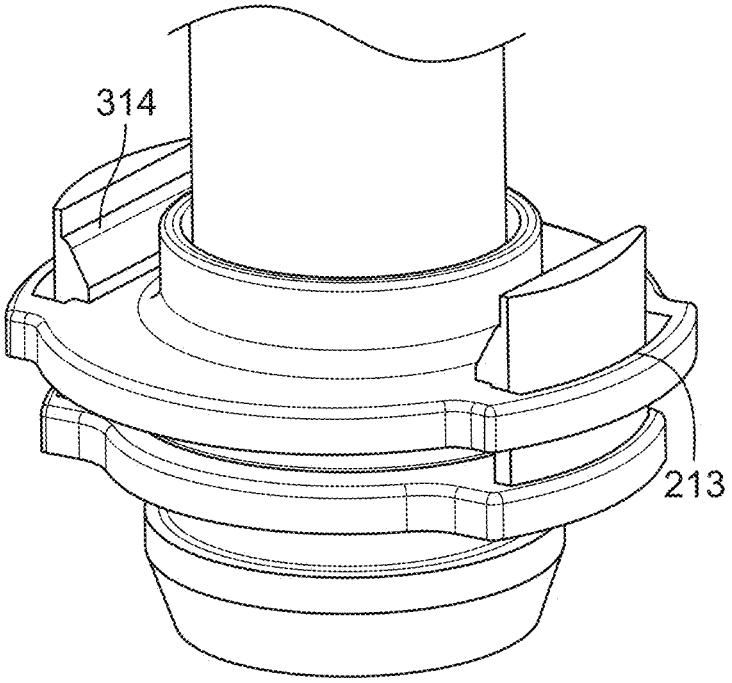
Figure 5:
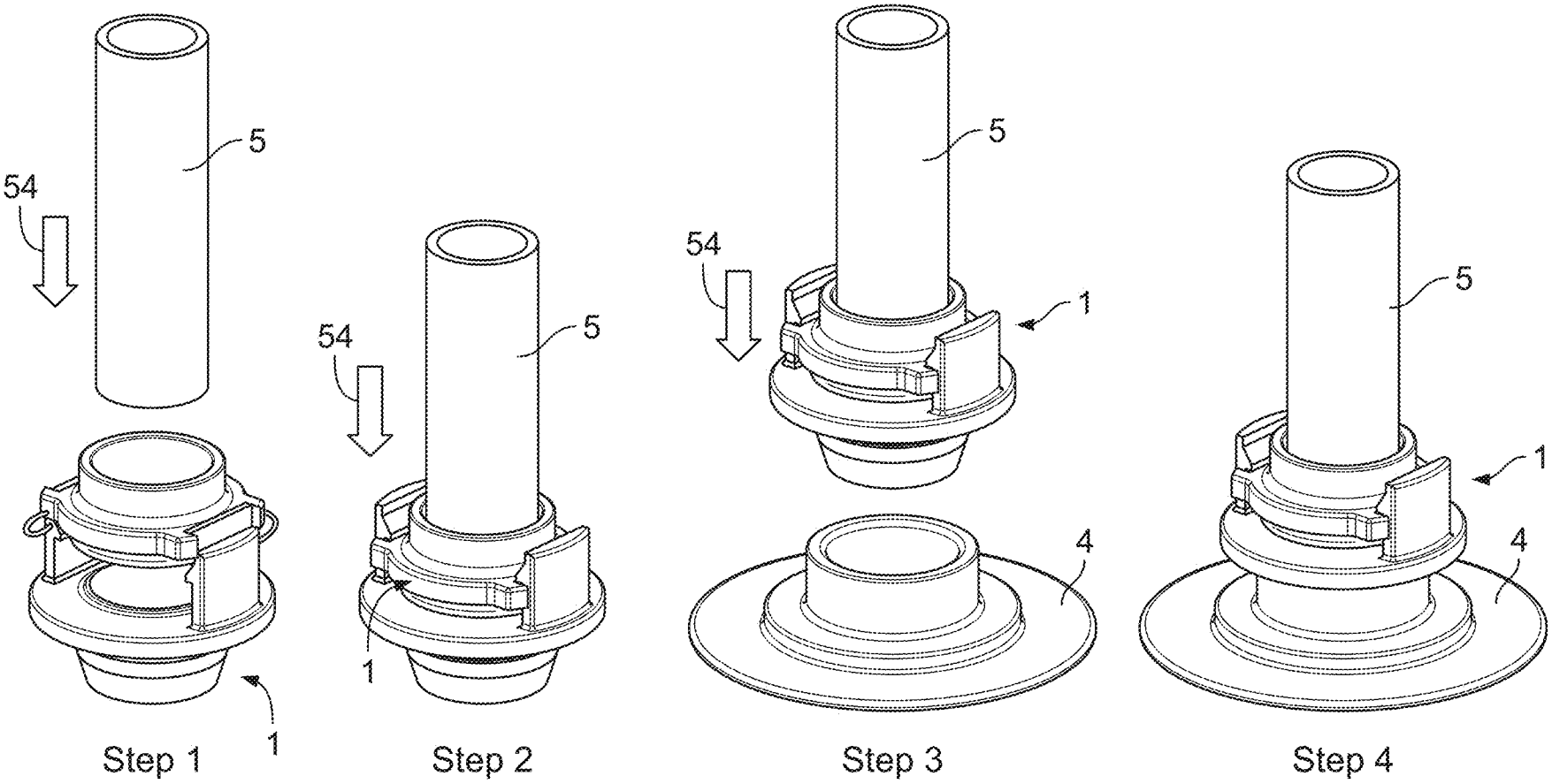
FIG. 5 is a sequential series of three dimensional views of the tube, tube adapter, and spout fitment highlighting the steps by which the tube is attached to the adapter and then the adapter is attached to the spout fitment. It will be understood these processes can occur prior to or after the spout fitment is sealed to the pouch/bag.
Figure 6A:
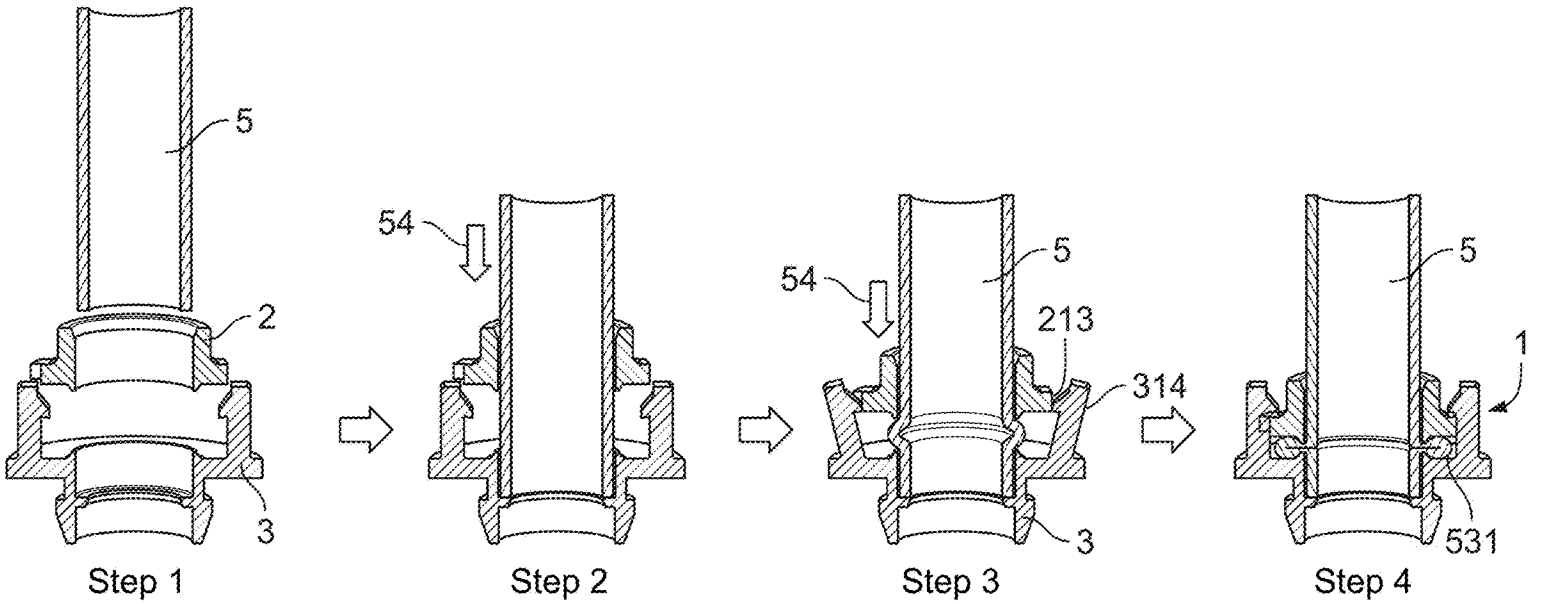
FIGS. 6A and 6B are sequential series of cross sectional images showing the attachment of the tube base to the spout base and the capture/bellowing seal created in/by the tube within the adapter (FIG. 6A), as well as the detachment and removal of the tube base (FIG. 6B).
Figure 6B:
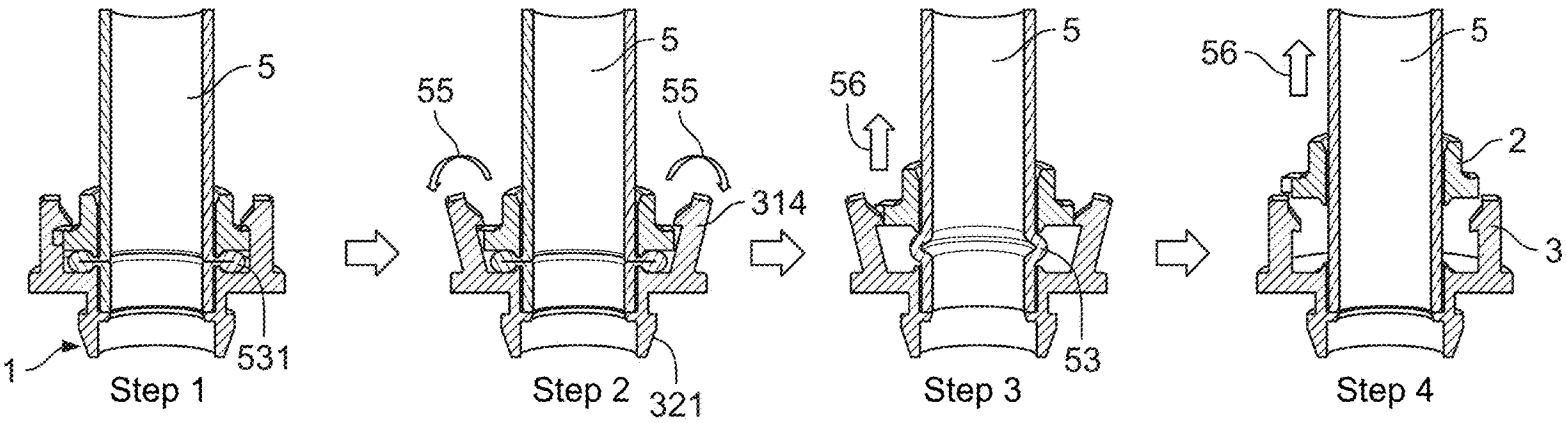

FIGS. 4A through 4C provide exemplary arrangements, although the number of cooperating features can be adjusted to include more than two, diametrically opposed sets. Also, the shape of the aperture 123 provided for a sufficient radial gap so that the wedge 124 (or axially extensions on which the wedges are provided) can be flexed inward by radial release force 55 (as shown in FIG. 6B) or an outwardly applied release force to dislodge the wedges 134 off and away from the ledge 133. As used and depicted herein, the "wedges" are ramped or tampered sections disposed to slide over and temporarily flex away from their corresponding capture/engagement surface, with the wedge typically located at or near the distal end of an axially aligned post (so as to allow for sufficient bending during the locking/engagement of the wedge to the surface). In turn, the slot, aperture, or flanged capture surface will have an angled surface (preferably, a right angle) that is selected to cooperate with and capture the underside of the wedge. The wedge and aperture/flange will be positioned and designed to accommodate axial movement to establish the coupling/capture relationship.

In some aspects, the locking mechanism will include a pair of features diametrically opposed at opposite ends of the flange 23, 33 of each base 2, 3, although one, two, or multiple additional pairs of features can be provided. While the features are shown as being identical (i.e., so that in FIG. 1C as an example, the tube base includes two capture wedges 213 and the spout base two apertures 214), it is possible to form different but complimentary features (i.e., one wedge and one aperture) on each base. The wedges may be disposed on inner facings of the post or on outer facings of the post, depending upon the positioning of the corresponding slot/aperture/flange.

Figure 2A:
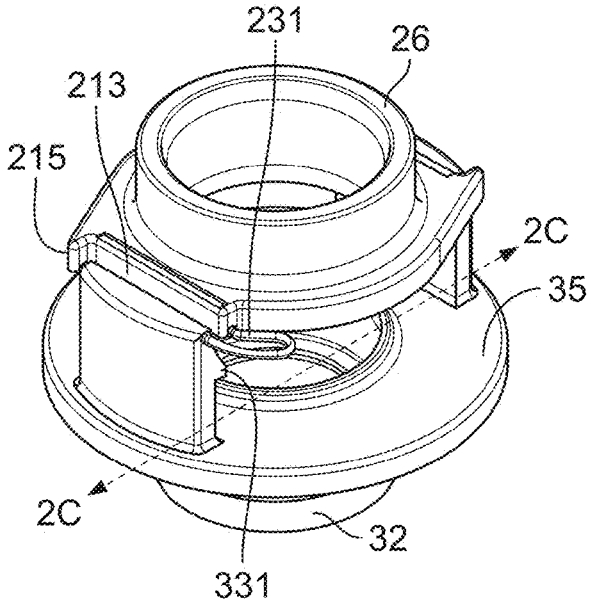
FIG. 2A is a three dimensional view of the tube adapter, taken from the top facing and highlighting the tethered connection of the tube base to the spout base in the adapter platform.
Figure 2B:
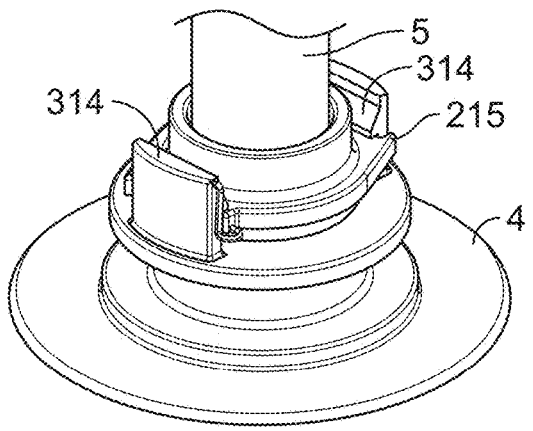
FIG. 2B is a three dimensional view of the adapter of FIG. 2A in its fully assembled state, with the tube and spout fitment included.
Figure 2C:
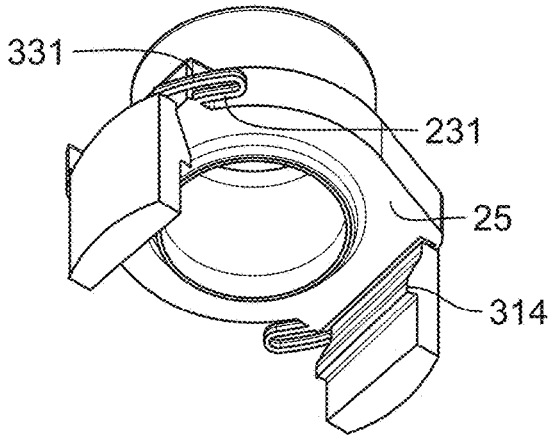
FIG. 2C is a cross sectional three dimensional view, taken from the bottom facing along the plane coinciding with line 2C-2C in FIG. 2A so as to highlight the tethered connection and bellowing formation/ridge formed on the bottom facing of the tube base of the adapter contemplated in FIG. 2A.
Figure 3A:
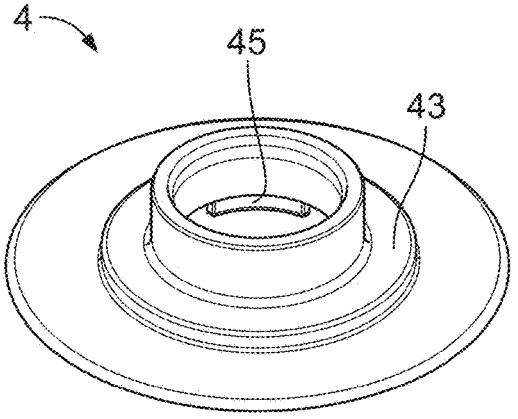
FIGS. 3A and 3B are complimentary three dimensional top and bottom views of a spout fitment appropriate for use with the various aspects of the tube adapter contemplated herein.
Figure 3B:
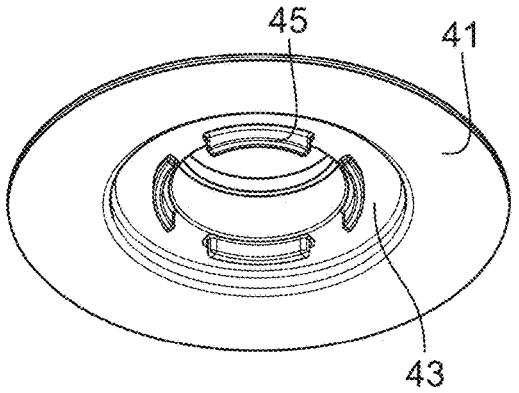

Tube base 2 has an annular or ring-shape centered around the flow channel 14. An extension tube 26 includes an inner beveled edge 262 that facilitates positioning and receipt of the proximal edge 51 extending down from the main body 52 of the tube 5. The inner facing 261 of the extension tube 26 can be imparted with engagement features to better grip and retain the outer surface of the tube 5, although the tube 5 must be able to slide axially down through the tube 26 in order to engage the spout base 3, as will be described below. A radial flange 23 protrudes away from the outer surface of the cylindrical extension 26 so as to accommodate locking features 21. As can be seen in FIGS. 2A through 2C, capture ledge 213 includes a straight edge that can engage the wedge 314 on the spout base 3. A indexing guide 215 can be positioned at one or both ends of the straight edge to facilitate positioning the wedge 314 on the ledge 213. As suggested above, ledge 213 could be replaced by a wedge 214 (with the spout base 3 providing a capture ledge 313 with straight edge and optional indexing guide(s)). Apertures could also be used employed when a slot and bayonet configuration is preferred.

A tether 231 is provided on an outer facing of the extension tube 26 and/or flange 23. This tether 231 connects integrally to a similar tether 331 on the spout base 3. The tethers 231, 331 provide and maintain a physical connection between the bases 2, 3 that allow for molding the bases 2, 3 as a single unit and, possibly, in a single shot process. The tethers 231, 331 will be thin, string-like extensions that can bend and move in the axial and radial directions, so as to enable the coupling and release processes shown in FIGS. 5 through 6B. In some aspects, the tethers 231, 331 could be engineered to detach and effectively provide a tamper evident feature indicating the first time the adapter 1 is coupled to a spout fitment 4.

Along its lower facing 25, the tube base 2 will be essentially flat (e.g., aligned in a common spatial plane). However, a bellowing feature 251, such as annular bead or intermittent series of ridges will extend axially down and away from the facing 25. Correspondingly, along the upper facing 35 of the spout base 3, an bellowing feature/ridge 351 extends upward beyond the flat and/or common spatial plane of the facing 35. The features 251, 351 will have approximately the same size and shape so that, when the bases are collapsed together, the features 251, 351 facilitate formation of an outward bulge in the tube 5, resulting in compressed folds 531.

The bellowing or compressed section 53 is sandwiched between the facings 25, 35, thereby serving as an o-ring and gasket to maintain spacing. Upon release (as in FIG. 6B), the compressed folds 531 may retain sufficient resilience to facilitate separation and contribute to the upward disconnection force 56 needed to move the tube base 2 away from the spout base 3.

The spout base 3 will also have an annular shape to define portions of the flow channel 14. Here, a lower extension tube 32 has engagement features 321 on its outer surface that can cooperate with features on the inner surface of the tube 42 or along the of the spout fitment 4. Additionally, a ledge 34 protrudes inwardly on the tube 32 to serve as a stop and positioning/retention mechanism for the proximal end 51 of the tube 5. The elevation of the ledge 34 may coincide with the lower most end of the tube 32, or it can be positioned along a midpoint (or otherwise below the ridge 351).

A radial flange or protrusion 33 provides a location for the tether 331 to be attached, as well as for the various locking features 31, in the form of an aperture/ledge 313 or a flange/wedge 314 all as described above.

Notably, the locking features 21, 31 must be positioned near the peripheral edges of both bases 2, 3, while the lower extension tube 32 has a smaller inner and outer diameter than those features 11 so as to provide for a coaxial reception/connection. The inner diameter of the upper extension tube 26 should also be comparable/similar or, preferably, identical to that of the lower tube 32, so as to allow for the tube 5 to pass along the axis/central path 14 to seat its proximal end 51 on the ledge 34. If these inner diameters are not identical, the inner diameter of the upper tube 26 is preferably larger than that of the lower tube 32.

In the same manner, the lower edge of the lower tube 32 extends to downward at or to a lower elevation than will be attained by the lower most edge of the locking features 21, 31, so as to insure the secure connection of the adapter 1 to the fitment 4. Thus, the axial spacing of the downward facing, axially extending components, as well as the interfacing horizontal surfaces 25, 35 (relative to the surface of the spout) and the axial thickness of the compressed folded section 531, can all be selected and adjusted to allow or prevent access to exert squeezing force to release the locking mechanism. Conversely, by providing only upward extending, resilient posts with capture wedges 314 from the top of the spout base 3, the locking mechanism 11 remains more accessible, and/or the radial flange 33 may come into contact with (or remain extremely close to) the radial flange 41 of the spout 4 (or the bag surface).

In some aspects, the invention contemplates the combination of the tube adapter 1 and the dispensing tube 5. In such cases, appropriate guides or positioning tools can be employed to align the tube to the adapter and/or the adapter. Alternatively, aspects of the inventive assembly may also include the spout fitment 4, in which case the tooling may be further modified to facilitate attachment of the tube 5 to the adapter 1 and, separately, the adapter 1 to the spout fitment 4.

Corresponding methods of using such an adapter and, separately, for sealing an adapter to a spout fitment are also contemplated. With reference to steps 1-4 in FIGS. 5 and 6A, a user first attaches a spout fitment to a flexible pouch and a flow channel defining an outlet. Next, the distal end of a tube is passed through the aligned openings in a tube base and spout based, both of which formed as a single unitary piece optionally joined by a tether. The distal end is forced into a resting position on an inner ledge formed on the spout base. A support tool is inserted along the inner lumen of the tube and compressive axial force is exerted on the tube base and/or the tube itself, thereby urging the tube base into a locked position relative to the spout base. To facilitate locking, the tube base and the spout base are provided with locking mechanisms as described above. The compressive force, combined with the presence of the tool, causes a section of the tube to bellow outward around ridges formed on the horizontal and interfacing surfaces at the bottom of the tube base and the top of the spout base. The outward bellowing of the tube creates a compressed folded section in the tube that serves as a gasket and spacer to maintain the locked positioning of the tube and spout bases, thereby producing a subassembly. The subassembly is then urged onto the outlet of the spout fitment so as to lock the subassembly onto the spout fitment.

In further aspects, steps 1-4 of FIG. 6B shows how the tube base may be detached from the spout base. Here, radially outward and/or downward force is applied to the locking mechanism coupling the bases together. Resilient components in the locking mechanism release, and upward force is applied to the tube and/or tube base. Additionally, the decompression of the section 531 may provide additional upward force. As a result the tube base unlocks and disconnects from the spout base.

The locking mechanisms 11 described above all rely upon axially movement to urge the tube base 2 toward the spout base 3, although some aspects can include a subsequent twisting or rotational force to further assure the alignment and/or to lock the components 12, 13 in place. For example, as seen in FIG. 2A, when a single key 215 is provided at only one end of the ledge 213, it can serve as a stopper so that the user can twist the tube base 2 relative to the spout base 3 to insure the components are aligned. This arrangement can be further modified so that the interface of the components along the key 215 and one of the vertical facings of the post that does not include constitute the capture wedge 314 occurs in two distinct planes (e.g., one coinciding with the vertical and the other with the horizontal). Allowing for engagement along two distinct facings provides assurance the components are aligned accordingly, and one or more vertically aligned capture wedges on the post could even key 215 in that plane (rather than the single horizontally-aligned plane, as is more easily seen in FIG. 2B).

Figure 7:
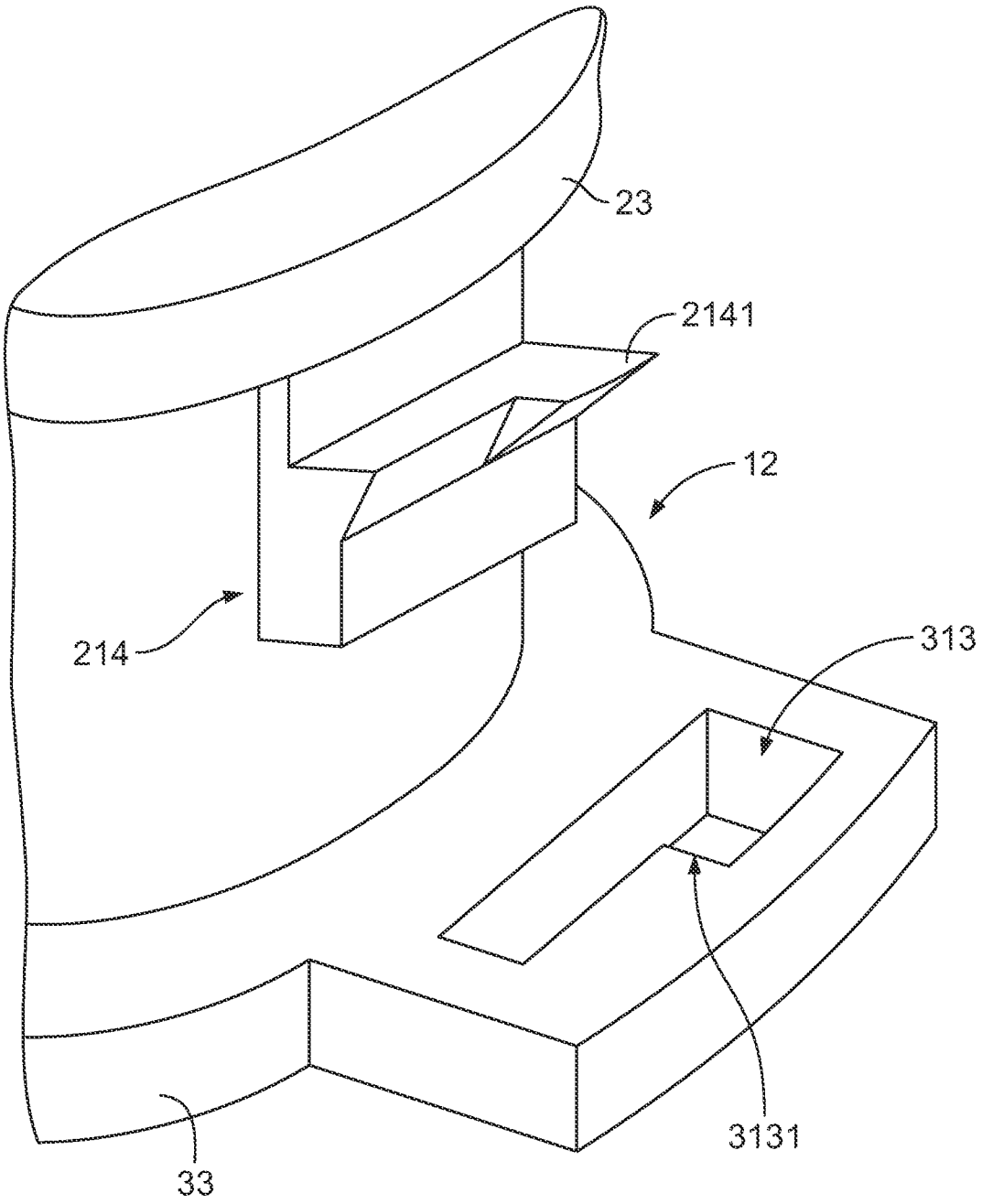
FIG. 7 is a three dimensional view of the locking mechanism on/between the spout base and the tube base showing how these components can be modified to allow for a complimentary rotational movement to further secure the components.

FIG. 7 provides further illustrations of these rotational locking features. In particular, in slot-and-bayonet configuration 12 is shown where the flange 23 on the tube base includes an axially aligned post with a capture wedge 214 protruding radially away. At one edge/side of the wedge 214, an enlarged portion 2141 can serve as an indexing guide that cooperates with a similarly enlarged opening 3131 within the slot 313 provided on the flange 33 of the spout base 3. This type of arrangement can allow for one of two rotational capture schemes. In the first, the wedge 214 is inserted into the aperture 313 and then twisted so that the upper facing the enlarged portion 2141 catches on the bottom facing adjacent to and defining the slot 313. Additionally or alternatively, a vertical edge of the enlarged portion 2141 (or even the wedge 214 itself) could be configured with coupling features that lock into a vertical facing of the slot 313, possibly including or solely limited to the enlarged portion 3131. In some aspects, ramps or threads can be imparted to serve as guides that facilitate both axial and rotational movement, with these guides corresponding to the desired sequence of movements required to couple and lock the locking mechanism 11 in place (e.g., with circumferentially-aligned portions, axially-aligned portions, and/or helically sloping portions).

To be clear, numerous other rotational engagements can be provided, both in the slot and bayonet configuration 12 like that in FIG. 7, as well as in the capture flange/wedge arrangement 13 shown in FIGS. 2A and 2B. In each instance, an axial force will initially engage portions of the locking mechanism 11 on each of the tube base 2 and the spout base 3, after which these components are twisted or rotated relative to one another so as to engage a second set of features to lock and/or better align the components in question. These second set of features can coincide with or be formed separately from the initially engaged features, and any number of additional configurations can be and are encompassed by this disclosure.

In view of the foregoing, one aspect of the invention contemplates a tube adapter assembly for coupling a dispensing tube to a spout fitment on a flexible pouch. This adapter is formed an unitary annular component, preferably made completely from polymers (and most preferably, the same polymeric material), with the adapter defining an axially-aligned inner flow channel. A tube base and a spout base are formed in/as part of the unitary annular component. The tube base includes an upper extension cylinder, defining a portion of the inner flow channel, and a tube base flange extending radially away from the upper extension cylinder, wherein the tube base flange including a tube base locking mechanism arranged near a periphery thereof and the spout base includes a lower extension cylinder, defining a portion of the inner flow channel, and spout base flange extending radially away from the lower extension cylinder, wherein the spout base flange includes a spout base locking mechanism arranged near a periphery thereof and wherein the lower extension cylinder includes an inwardly extending ledge. A dispensing tube is provided as part of the assembly, and that tube is received along the inner flow channel in both of the tube base and the spout base, with a distal end of the dispensing tube seated on the inwardly extending ledge and bellowing section of the tube captured between the tube base and spout base when the tube base locking mechanism and the spout base locking mechanism are coupled together. Additional aspects may include one or any combination of the following features:

- a spout fitment also defining a portion of the inner flow channel, wherein the lower extension tube is coaxially received and coupled to the spout fitment along an interfacing surface of the inner flow channel of the spout fitment;
- wherein the lower extension tube is coupled to the spout fitment by tapered wedge on an outer surface of the lower extension tube that engages a corresponding ledge on a lower facing of the spout fitment;
- wherein the corresponding ledge is one or a series of arcuate extensions extending axially down from the spout fitment;
- wherein the spout fitment is coupled to a flexible bag along a radial flange extending away from an axial engagement tube defining the inner flow channel in the spout fitment;
- wherein the tube base locking mechanism and the spout base locking mechanism consist of a slot and bayonet configuration or a post and flange configuration;
- wherein the locking mechanism includes a wedge positioned a resilient post;
- wherein the bellowing section of the dispensing tube is engaged by an axially extending bellowing ridge on one or both of the tube base and the spout base;
- wherein the tube base and the spout base are connected by one or more tether strips, with a length of the tether strip selected to allow movement of the tube base and the spout base as the tube base locking mechanism and the spout base locking mechanism are coupled together;
- wherein the unitary annular component consists of injection molded polyethylene and/or the dispensing tube consists of an elastomeric polymer;
- wherein at least one aperture or slot is formed in the tube base flange and/or the spout base flange; and
- wherein at least one axially aligned, resilient post with a capture wedge is formed in the tube base flange and/or the spout base flange.

The structures described above are comparatively easy to mold, manufacture, and assemble, particularly in comparison to the designs noted in the Background section above. Annular components are most ideally given a circular profile around the inner diameters/lumens, although the use of oval and/or keying projections could be useful in instances where a specific orientation of the components (e.g., spout in comparison to the adapter and/or tube) may be needed.

References to coupling, connection, or attachment in this disclosure are to be understood as encompassing any of the conventional means used in this field. This may take the form of snap- or force fitting of components having tabs, grooves, and the like. Nevertheless, threaded connections, annular or partial bead-and-groove arrangements, cooperating cam members, and slot-and-flange assemblies could be employed. Adhesive and fasteners could also be used, although such components must be judiciously selected so as to retain the desired characteristics of the assembly (including mono-material construction for sustainability/recycling purposes, detachability of some components, etc.).

In the same manner, engagement may involve coupling or an abutting relationship. These terms, as well as any implicit or explicit reference to coupling, will should be considered in the context in which it is used, and any perceived ambiguity can potentially be resolved by referring to the drawings.

All components should be made of materials having sufficient flexibility and structural integrity, as well as a chemically inert nature. The materials should also be selected for workability, cost, and weight. Common polymers amenable to injection molding, extrusion, or other common forming processes are useful, although a single grade is preferred.

In fact, another reason consumers, manufacturers, and others will find utility in these designs/components is precisely because of the use of only a single grade of polymer (e.g., polyethylene). This approach should simplify both manufacturing and recycling of the dispenser apparatus. The dispensing tube may still need to be made of an elastomeric polymer, particularly to the extent it is incorporate with a faucet-style spigot; however, the inventive designs herein allow for the unlocking of the tube clip, so as to enable the dispensing tube to be removed from the assembly/pouch combination (which can, thereafter, be recycled as a single polymeric material).

Certain grades of polypropylene and polyethylene are particularly advantageous, especially in view of the absence of any thermosetting resins, elastomeric polymer blends, and other chemically distinct polymers or copolymers (in comparison to the other components of the dispensing pump). Notably, high density polyethylene (i.e., having a density of greater than 0.940 g/cm$^3$) may provide different characteristics in comparison to lower density polyethylene types (e.g., medium density at 0.925 to 0.940 g/cm$^3$ and/or lower density at 0.880 to 0.925 g/cm$^3$), as would specialized blends or copolymers capable of cross-linking for the desired level of stiffness/rigidity. Other materials—and particularly recyclable, injection molding materials—could be useful, including without limitation polystyrene (including high impact and other grades), acrylonitrile butadiene styrene, and polyacetals (including polyoxymethylene, polyacetal, polyformaldehyde, and other grades).

Although the present embodiments have been illustrated in the accompanying drawings and described in the foregoing detailed description, it is to be understood that the invention is not to be limited to just the embodiments disclosed, and numerous rearrangements, modifications and substitutions are also contemplated. The exemplary embodiment has been described with reference to the preferred embodiments, but further modifications and alterations encompass the preceding detailed description. These modifications and alterations also fall within the scope of the appended claims or the equivalents thereof.

What is claimed is:

1. A tube adapter assembly for coupling a dispensing tube to a spout fitment on a flexible pouch, the adapter comprising:

an unitary annular component defining an axially-aligned inner flow channel and comprising a tube base and a spout base;

wherein the tube base includes an upper extension cylinder, defining a portion of the inner flow channel, and a tube base flange extending radially away from the upper extension cylinder, wherein the tube base flange including a tube base locking mechanism arranged near a periphery thereof, and wherein the spout base includes a lower extension cylinder, defining a portion of the inner flow channel, and spout base flange extending radially away from the lower extension cylinder, wherein the spout base flange includes a spout base locking mechanism arranged near a periphery thereof and wherein the lower extension cylinder includes an inwardly extending ledge; and a dispensing tube received along the inner flow channel in both of the tube base and the spout base, with a distal end of the dispensing tube seated on the inwardly extending ledge and bellowing section of the tube captured between the tube base and spout base when the tube base locking mechanism and the spout base locking mechanism are coupled together.

2. The assembly of claim 1 further comprising a spout fitment also defining a portion of the inner flow channel, wherein the lower extension tube is coaxially received and coupled to the spout fitment along an interfacing surface of the inner flow channel of the spout fitment.

3. The assembly of claim 2 wherein the lower extension tube is coupled to the spout fitment by tapered wedge on an outer surface of the lower extension tube that engages a corresponding ledge on a lower facing of the spout fitment.

4. The assembly of claim 3 wherein the corresponding ledge is one or a series of arcuate extensions extending axially down from the spout fitment.

5. The assembly of claim 2 wherein the spout fitment a radial attachment flange extending away from an axial engagement tube defining the inner flow channel in the spout fitment.

6. The assembly of claim 5 wherein the tube base locking mechanism and the spout base locking mechanism consist of a slot and bayonet configuration or a post and flange configuration.

7. The assembly of claim 6 wherein the locking mechanism includes a wedge positioned a resilient post.

8. The assembly of claim 1 wherein the bellowing section of the dispensing tube is engaged by an axially extending bellowing ridge on one or both of the tube base and the spout base.

9. The assembly of claim 1 wherein the tube base and the spout base are connected by at least one tether strip, with a length of the tether strip or tether strips selected to allow movement of the tube base and the spout base as the tube base locking mechanism and the spout base locking mechanism are coupled together.

10. The assembly of claim 1 wherein the unitary annular component consists of injection molded polyethylene.

11. The assembly of claim 1 wherein at least one aperture or slot is formed in the tube base flange and/or the spout base flange.

12. The assembly of claim 1 wherein at least one axially aligned, resilient post with a capture wedge is formed in the tube base flange and/or the spout base flange.

13. The assembly of claim 1 wherein the locking mechanism includes a rotational engagement feature.

* * * * *